US006926519B1

(12) United States Patent
Lusson

(10) Patent No.: US 6,926,519 B1
(45) Date of Patent: Aug. 9, 2005

(54) LIGHTER EXTENSION ASSEMBLY

(76) Inventor: Gregory Lusson, 21154 93rd Ave., Frankfort, IL (US) 60423

( * ) Notice: Subject to any disclaimer, the term of this patent is extended or adjusted under 35 U.S.C. 154(b) by 0 days.

(21) Appl. No.: 10/767,487

(22) Filed: Jan. 29, 2004

Related U.S. Application Data

(60) Provisional application No. 60/443,389, filed on Jan. 29, 2003.

(51) Int. Cl.[7] ..... F23D 14/46

(52) U.S. Cl. ..... 431/345; 431/254

(58) Field of Search ..... 431/254, 345

(56) References Cited

U.S. PATENT DOCUMENTS

| | | | | |
|---|---|---|---|---|
| 4,259,059 | A | 3/1981 | Roosa et al. | |
| 4,315,731 | A | 2/1982 | Moore | |
| 4,462,791 | A | 7/1984 | Hayden | |
| 5,135,388 | A * | 8/1992 | Pettit | 431/254 |
| D415,389 | S * | 10/1999 | Ferrara, Jr. | D7/416 |
| 6,086,360 | A * | 7/2000 | McDonough et al. | 431/255 |
| 6,428,309 | B1 * | 8/2002 | Doiron | 431/153 |

* cited by examiner

*Primary Examiner*—Stephen Gravini

(57) ABSTRACT

A lighter extension assembly includes an elongated extension member, a holster for holding a conventional disposable lighter, a main gripping portion, and a lighter ignition mechanism for providing linear movement by a lighter actuation assembly upon squeezing a trigger. The elongated extension member is telescopic and a supplemental handle may also be provided.

6 Claims, 2 Drawing Sheets

LIGHTER EXTENSION ASSEMBLY

CROSS REFERENCE TO RELATED APPLICATION

This application claims the benefit of U.S. Provisional Application No. 60/443,389, filed Jan. 29, 2003.

BACKGROUND OF THE INVENTION

1. Field of the Invention

The present invention relates to lighter accessories and more particularly pertains to a new lighter extension assembly for attaching to a lighter to permit ignition of the lighter and lighting of an item from an extended distance.

2. Description of the Prior Art

The use of lighter extensions is known in the prior art. U.S. Pat. No. 4,315,731 issued to Moore on Feb. 16, 1982 describes an elongated device having a lighter holster opposite a pistol grip trigger mechanism. Another type of lighter extension is U.S. Pat. No. 4,259,059 issued to Roosa et al. on Mar. 31, 1981 having an existing conventional lighter mounted on an extension having a lighter holder and a plunger or operating arm for selectively activating the lighter. U.S. Pat. No. 4,462,791 issued to Hayden on Jul. 31, 1984 discloses an elongated resilient member bent into a shape forming a holster positioned adjacent to an actuating end of the elongated resilient member such that squeezing adjacently positioned middle portions together actuates a lighter positioned in the holster.

While these devices fulfill their respective, particular objectives and requirements, the need remains for a lighter extension that is extendable to a desired length and provides superior structure to facilitate accurate positioning of a lighter held in an extended position.

SUMMARY OF THE INVENTION

The present invention generally comprises an elongated extension member, a holster for holding a conventional disposable lighter, a main gripping portion, and a lighter ignition mechanism for providing linear movement by a lighter actuation assembly upon squeezing a trigger. The elongated extension member is telescopic and a supplemental handle may also be provided.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
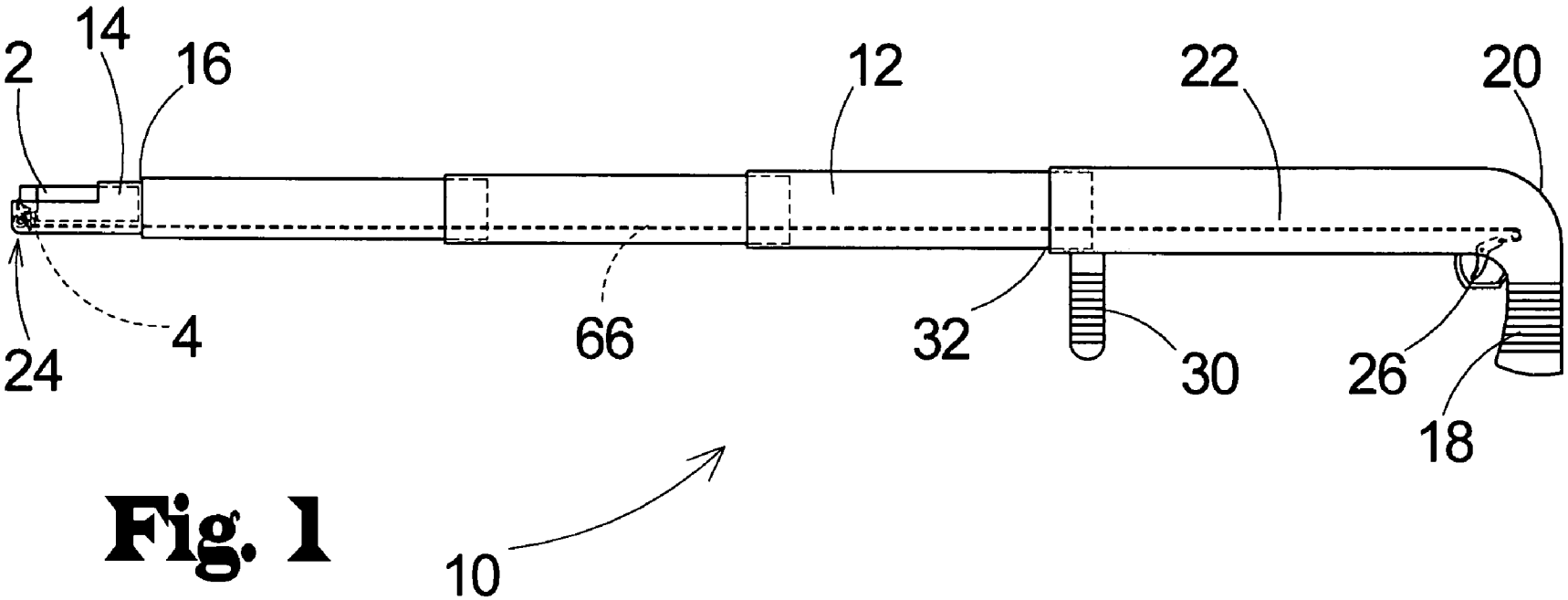
FIG. 1 is a side view of a new lighter extension assembly according to the present invention in an extended position.
Figure 2:
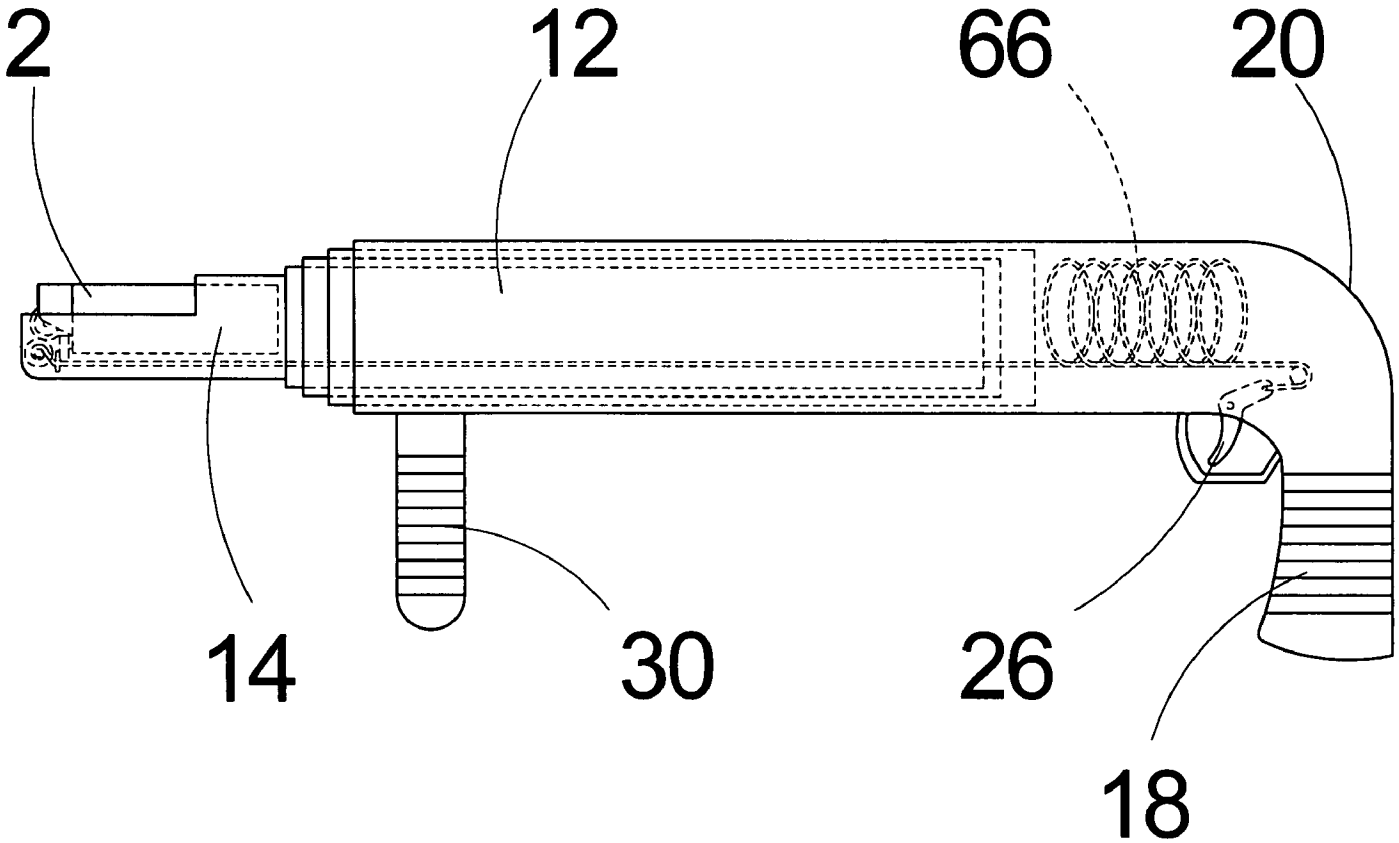
FIG. 2 is a side view of the present invention in a retracted position.

With reference now to the drawings, and in particular to FIGS. 1 through 2 thereof, a new lighter extension assembly embodying the principles and concepts of the present invention and generally designated by the reference numeral 10 will be described.

As best illustrated in FIGS. 1 through 2, the lighter extension assembly 10 is designed for holding a lighter 2 ignitable by a linear movement. The lighter extension assembly 10 comprises an elongated extension member 12 and a holster 14 designed for receiving and holding the lighter 2. The holster 14 is positioned at a distal end 16 of the elongated extension member 12. A main gripping member 18 extends from a proximal end 20 of the elongated extension member 12 opposite the holster 14. A lighter ignition mechanism 22 extends along the elongated extension member 12 between the distal end 16 of the extension member 12 and the main gripping member 18. An actuation assembly 24, such as is shown and employed in the prior art cited above, is operationally coupled to the lighter ignition mechanism 22 such that manipulation of the lighter ignition mechanism 22 moves the actuation assembly 24 to provide the linear movement required to ignite the lighter 2.

The lighter ignition mechanism 22 includes a trigger 26 positioned adjacent to the main gripping member 18 such that the trigger 26 is designed for being engaged by a finger of a hand grasping the main gripping member 18.

Preferably, the actuation assembly 24 remains in contact with a gas release mechanism 4 of the lighter 2 while the trigger 26 is held in a pulled position.

The elongated extension member 12 is telescopic to facilitate adjustment of a distance of the lighter 2 from the main gripping member 18. In this embodiment, the lighter ignition mechanism 22 includes a cable member 66 operationally coupled to the trigger 26 in a fashion similar to the use of a brake cable to remotely actuate bicycle brakes using a squeezing motion remote from the brake calipers. Thus, the extension member 12 may be adjusted back and forth without having to readjust the lighter ignition mechanism 22.

In an embodiment, a supplemental handle 30 extends from a medial portion 32 of the elongated extension member 12 in spaced relationship to the main gripping member 18 to facilitate handling and controlling movement of the elongated extension member 12 during use.

In use, the lighter is positioned in the holster in an orientation such that the linear movement of the actuation assembly will properly engage the lighter to provide ignition. The extension member is adjusted if necessary to the desired length when a telescopic extension member is utilized. The trigger is pulled by a finger of a hand grasping the main gripping member. The lighter is ignited by the linear movement of the actuation assembly caused by pulling the trigger. The user releases the trigger to extinguish the lighter.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lighter extension assembly for holding a lighter ignitable by a linear movement, said lighter extension assembly comprising:

an elongated extension member;

a holster adapted for receiving the lighter, said holster being positioned at a distal end of said elongated extension member;

a main gripping member extending from a proximal end of said elongated extension member opposite said holster;

a lighter ignition mechanism extending along said elongated extension member between said distal end of said extension member and said main gripping member;

an actuation assembly operationally coupled to said lighter ignition mechanism such that manipulation of said lighter ignition mechanism moves said actuation assembly to provide the linear movement to ignite the lighter; and a supplemental handle extending from a medial portion of said elongated extension member in spaced relationship to said main gripping member such that said supplemental handle is positioned between said main gripping member and said holster to facilitate handling and controlling movement of said elongated extension member during use.

2. The lighter extension assembly of claim 1, further comprising:

said lighter ignition mechanism including a trigger positioned adjacent to said main gripping member such that said trigger is adapted for being engaged by a finger of a hand grasping said main gripping member.

3. The lighter extension assembly of claim 2 wherein said actuation assembly remains in contact with a gas release mechanism of the lighter while said trigger is held in a pulled position.

4. The lighter extension assembly of claim 2 wherein said elongated extension member is telescopic to facilitate adjustment of a distance of the lighter from said main gripping member.

5. The lighter extension assembly of claim 4 wherein said lighter ignition mechanism includes a cable member operationally coupled to said trigger.

6. A lighter extension assembly for holding a lighter ignitable by a linear movement, said lighter extension assembly comprising:

an elongated extension member;

a holster adapted for receiving the lighter, said holster being positioned at a distal end of said elongated extension member;

a main gripping member extending from a proximal end of said elongated extension member opposite said holster;

a lighter ignition mechanism extending along said elongated extension member between said distal end of said extension member and said main gripping member;

an actuation assembly operationally coupled to said lighter ignition mechanism such that manipulation of said lighter ignition mechanism moves said actuation assembly to provide the linear movement to ignite the lighter; and a supplemental handle extending from a medial portion of said elongated extension member in spaced relationship to said main gripping member such that said supplemental handle is positioned between said main gripping member and said holster to facilitate handling and controlling movement of said elongated extension member during use;

said lighter ignition mechanism including a trigger positioned adjacent to said main gripping member such that said trigger is adapted for being engaged by a finger of a hand grasping said main gripping member;

said actuation assembly remaining in contact with a gas release mechanism of the lighter while said trigger is held in a pulled position;

said elongated extension member being telescopic to facilitate adjustment of a distance of the lighter from said main gripping member; and said lighter ignition mechanism includeing a cable member operationally coupled to said trigger.

* * * * *